US005474502A

United States Patent [19]

Brown

[11] Patent Number: 5,474,502

[45] Date of Patent: Dec. 12, 1995

[54] BILLIARDS BRIDGE

[76] Inventor: Ulysses S. A. Brown, 1610 Verla La., Escondido, Calif. 92027

[21] Appl. No.: 225,569

[22] Filed: Apr. 11, 1994

[51] Int. Cl.[6] ..... A63D 15/10

[52] U.S. Cl. ..... 473/42

[58] Field of Search ..... 473/42

[56] References Cited

U.S. PATENT DOCUMENTS

| | | | |
|---|---|---|---|
| 890,789 | 6/1908 | Nelson | 473/42 |
| 1,105,478 | 7/1914 | Ames . | |
| 2,817,525 | 12/1957 | Niemann | 273/23 |
| 2,931,649 | 4/1960 | Furda | 273/23 |
| 3,372,929 | 3/1968 | Molis | 273/23 |
| 3,416,794 | 10/1968 | Clano | 473/42 |
| 3,544,111 | 12/1970 | Crisman et al. | 273/24 |
| 3,576,324 | 4/1971 | Lareau | 273/23 |
| 3,851,876 | 12/1974 | Baker | 273/24 |
| 4,053,153 | 10/1977 | Josenhans | 273/23 |
| 4,147,346 | 4/1979 | Gianetti | 273/23 |
| 4,215,859 | 8/1980 | Charlton | 473/42 |
| 4,907,799 | 3/1990 | Danner | 473/42 |

FOREIGN PATENT DOCUMENTS

| | | | |
|---|---|---|---|
| 309768 | 4/1929 | United Kingdom | 473/42 |

*Primary Examiner*—Theatrice Brown
*Attorney, Agent, or Firm*—Brown Martin Haller & McClain

[57] ABSTRACT

A body having a handle portion and a frame portion. The frame portion has an opening with one or more channels, which may be defined by adjoining walls, grooves or paired protuberances, for cradling the cue. A player braces the handle portion against the table and inserts the cue through the opening with the cue cradled in a channel. A slide having a slide channel may be disposed in the opening of the frame. A resilient member, such as a rubber O-ring, spans the frame and is connected to the slide. The player inserts the cue between the slide and the frame channel. The resilient member biases the slide channel against the cue, which, in turn, bears against the frame channel. The cue is thus captivated between the slide channel and the frame channel while the player makes a shot.

19 Claims, 1 Drawing Sheet

BILLIARDS BRIDGE

BACKGROUND OF THE INVENTION

The present invention relates generally to the games commonly called billiards or pool and, more specifically, to a bridge for supporting and steadying a cue.

A cue is tapered rod with a blunt tip that is used in the game of billiards to strike a ball and thus propel it across the surface of a table. (The word "billiards," as used herein, encompasses all such games in which a cue is used in this manner.) To make a shot, a player typically forms a bridge with one hand to support and steady the cue with respect to the table. While a portion of the bridge, typically the player's fingertips, remains firmly planted on the table, the player uses his other hand to place the cue on the bridge and slide the cue into contact with the ball. The player may form an "open bridge," where the player's knuckles simply cradle the cue, or a "closed bridge," where the player's finger completely surrounds the cue. The bridge allows the player to slide or reciprocate the cue freely in the direction of the axis of the cue and also allows the player to pivot the cue to some extent in directions perpendicular to its axis, i.e., directions that are horizontal and vertical with respect to the billiard table surface, without moving the portion of his hand that remains in contact with the table. However, the bridge restrains the cue against horizontal and vertical movement at the point where it contacts the bridge.

A player may use an auxiliary mechanical bridge instead of forming a bridge with his hand. Such bridges are typically of the open variety and have one or more "V"-shaped grooves for cradling the cue. The bridge may be attached to the end of a cue-like bridge stick that allows a player to support the cue at a point on the billiards table at which it would be difficult for him to form a bridge with his hand. U.S. Pat. No. 2,817,525, issued to Niemann, and U.S. Pat. No. 3,576,324, issued to Lareau, disclose examples of such bridges.

Other types of bridges may be gripped directly by the player without the aid of a bridge stick. U.S. Pat. No. 1,105,478, issued to Ames, U.S. Pat. No. 3,851,876, issued to Baker, and U.S. Pat. No. 4,053,153, issued to Josenhans, disclose open bridges that players grip with their fingers. The devices disclosed in the latter two patents can also be used for training a player to form a bridge with his hand.

Developing an auxiliary closed bridge is problematic for practitioners in the art because it must restrain the cue against movement in horizontal and vertical directions but allow it to move freely in the axial directions. U.S. Pat. No. 2,931,649, issued to Furda, addresses these problems in one embodiment by providing two semicylindrical resilient members that are biased together to cradle the cue between them and, in another embodiment, by providing a resilient leaf spring that biases the cue against a fixed portion of the bridge. U.S. Pat. No. 4, 147,346, issued to Gianetti, addresses the problems associated with auxiliary closed bridges by providing two semicylindrical members that are hinged together and spring-biased to cradle the cue between them. The semicylindrical members are lined with ball bearings to minimize friction.

It would be desirable for an auxiliary bridge to allow a player to move the cue through a range of motion similar to that which a bridge formed by a player's hand allows. The closed bridges known in the art do not allow a player to pivot the cue while a portion of the bridge remains fixed with respect to the table. In addition, the closed bridges known in the art include complex mechanisms, such as spring-biased hinges, which are uneconomical of manufacture. These problems and deficiencies are clearly felt in the art and are solved by the present invention in the manner described below.

SUMMARY OF THE INVENTION

The present invention comprises a body having a handle portion and a frame portion. The frame portion has an opening with one or more frame channels, which may be defined by adjoining walls, grooves, notches or paired protuberances, for cradling the cue. A player braces the handle portion against the table and inserts the cue through the opening with the cue cradled in a frame channel. A player may thus use the invention as an open bridge.

A slide may be disposed in the opening of the frame, thereby forming a closed bridge. A resilient member, such as an elastomeric O-ring, spans the frame and is connected to the slide. The player inserts the cue between the slide channel and the frame channel. The resilient member biases the slide channel against the cue, which, in turn, bears against the frame channel. The cue is thus captivated between the frame channel and the slide channel.

The player can slide or reciprocate the cue in an axial direction because the channels of the slide and frame minimize frictional resistance. The player can also adjust the orientation of the cue by pivoting it in horizontal or vertical directions about the frame channel. Flexure of the resilient member allows the slide to pivot. During either axial or pivoting motion, the cue remains firmly secured between the respective channels of the frame and the slide because the resilient member maintains a biasing force on the cue.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
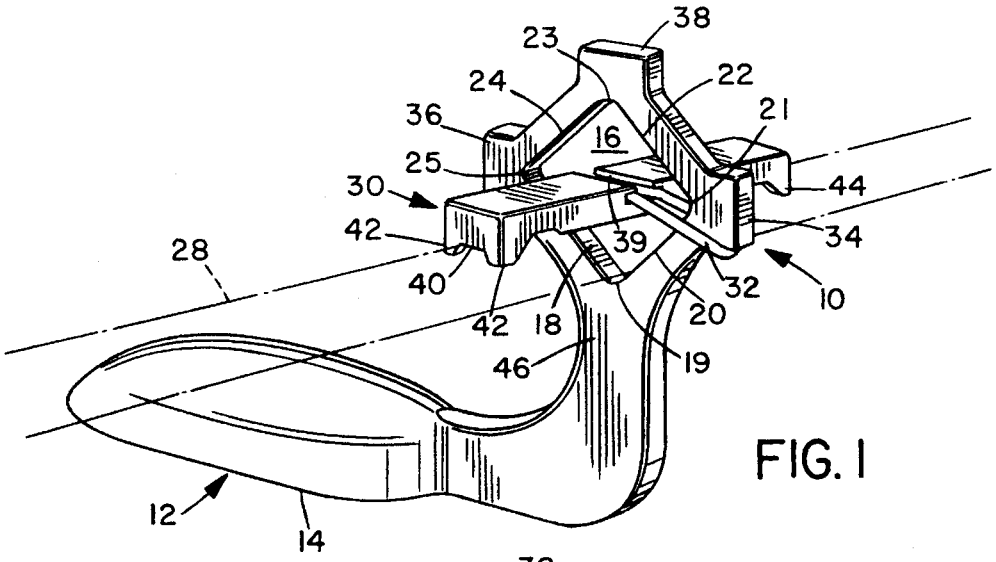
FIG. 1 is a perspective view of the bridge, including a resiliently biased slide, with a cue retained therein.
Figure 2:
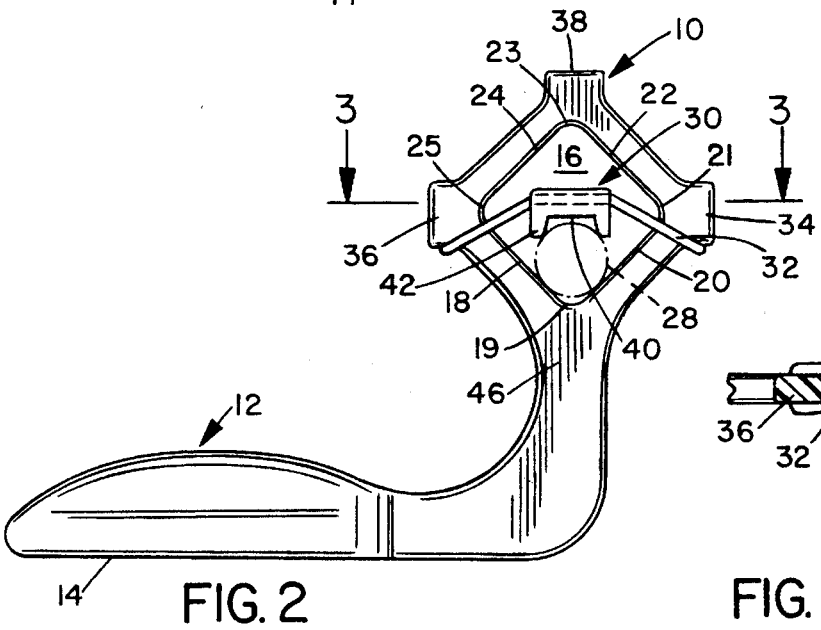
FIG. 2 is a front elevational view of the bridge.
Figure 3:
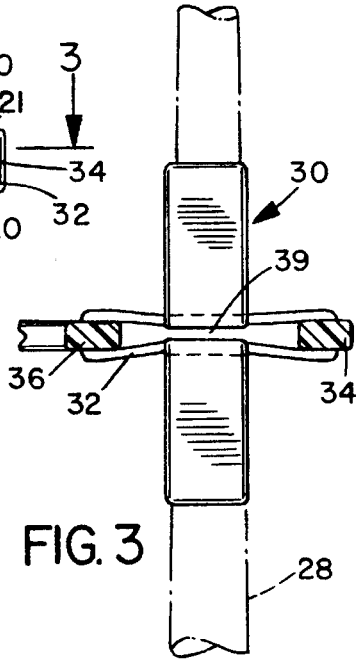
FIG. 3 is a sectional view taken on line 3—3 of FIG. 2.

As illustrated in FIGS. 1–3, a frame 10 and a handle 12 are integrally formed from a suitable low-friction material, such as metal or a strong, rigid plastic such as polycarbonate or nylon. In other embodiments, handle 12 may be made of a different material from frame 10.

Handle 12 preferably has a flat bottom surface 14 that a billiards player (not shown) may place against the billiards table (not shown) to brace the bridge when making a shot. Although handle 12 may have any ornamental shape or features, it should be easily gripped by a player.

Frame 10 has a generally planar or panel-like shape with an opening 16. Opening 16 has four sides 18, 20, 22 and 24 of equal lengths, defining a square shape. The corners where adjacent ones of sides 18, 20, 22 and 24 meet define frame channels 19, 21, 23 and 25 in which a cue 28 may slide.

A slide 30, which may be made of any suitable low-friction material such as anodized aluminum or nylon, is suspended in opening 16 by an elastomeric O-ring 32. O-ring 32 is retained between protuberances 34 and 36. Slide 30 has a groove 39 in which O-ring 32 is received. Slide 30 has a slide channel 40, which is defined by two pairs of protuberances 42 and 44. O-ring 32 biases slide 30 toward cue 28, which, in turn, bears against frame channel 19. Cue 28 is thus captivated between frame channel 19 and slide channel 40 but may slide freely back and forth in the axial direction while a player makes a shot. Cue 28 may also be pivoted in frame channel 19 throughout a range of angles with respect to frame 10 while remaining captivated.

A player may hold handle 12 in any orientation and may brace the bridge by placing any suitable portion of handle 12 or frame 10 in contact with a portion of the billiards table. For example, as described above, bottom surface 14 of handle 12 may lay flat against the surface of the billiards table. To use the bridge in this orientation, cue 28 should be cradled in frame channel 19, as shown in FIGS. 1–3 and 6. In another orientation, bottom surface 14 of handle 12 may be substantially perpendicular to the surface of the billiards table, with a portion of frame 10 in contact with the table. To use the bridge in this orientation, cue 28 should be cradled in frame channel 21. O-ring 32 should be retained between protuberance 38 and the neck 46 of frame 10. Cue 28 may be used with the bridge in still other orientations by cradling cue 28 in frame channel 23 with O-ring 32 retained between protuberances 34 and 36 or by cradling cue 28 in frame channel 25 with O-ring 32 retained between protuberance 38 and neck 46.

Figure 4:
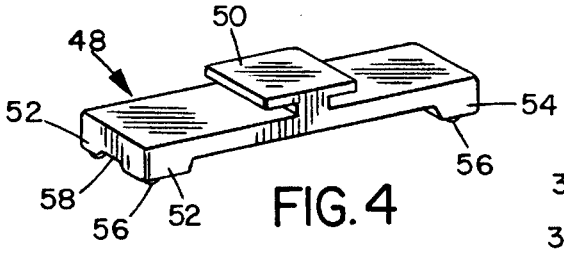
FIG. 4 is a perspective view of an alternative slide.
Figure 5:
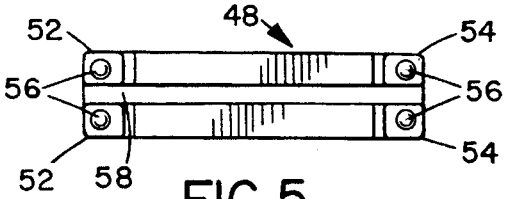
FIG. 5 is a bottom plan view of the alternative slide of FIG. 4.
Figure 6:
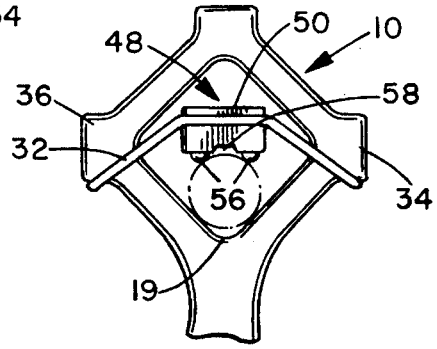
FIG. 6 is a view similar to a portion of FIG. 2, showing the suspension of the alternative slide of FIGS. 4 and 5.

As illustrated in FIGS. 4—6, an alternative slide 48 has a "T"-shaped projection 50, which performs the same function of receiving O-ring 32 as groove 39 of slide 30. Slide 48 is preferred because a slide having a projection 50 is easier and more economical to produce than a slide having a groove 39. Slide 48 has two pairs of protuberances 52 and 54. Each protuberance of pairs 52 and 54 has a ball bearing 56. As illustrated in FIG. 6, cue 28 slides on ball bearings 56, which together define a slide channel 58. As described above with respect to slide 30, O-ring 32 biases slide 48 toward cue 28, which, in turn, bears against frame channel 19. Cue 28 is thus captivated between frame channel 19 and slide channel 58. Slide 48 thus operates in the same manner as slide 30, but ball bearings 56 further reduce friction to allow cue 28 to slide more freely.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A bridge for playing billiards, comprising:

a body having a handle and a frame, said frame having an opening, said opening having at least one frame channel for cradling a cue;

a slide disposed in said opening having a slide channel for cradling said cue; and a resilient member spanning said frame and contacting said slide for biasing a cue cradled in said slide channel toward said frame channel.

2. The bridge claimed in claim 1, wherein said frame is generally planar.

3. The bridge claimed in claim 2, wherein said frame is less than 0.25 inches in a thickness dimension perpendicular to the plane in which said frame generally lies.

4. The bridge claimed in claim 2, wherein said handle has a flat surface, and the plane in which said frame generally lies is perpendicular to said flat surface.

5. The bridge claimed in claim 1, wherein said handle is oriented at an angle with respect to said frame.

6. The bridge claimed in claim 5, wherein said handle is perpendicular to said frame.

7. The bridge claimed in claim 1, wherein said resilient member is an O-ring.

8. The bridge claimed in claim 7, wherein said slide has a groove for receiving said O-ring.

9. The bridge claimed in claim 7, wherein said slide has a T-shaped protuberance for receiving said O-ring.

10. The bridge claimed in claim 1, wherein said opening has a plurality of frame channels.

11. The bridge claimed in claim 10, wherein said frame has a plurality of attachment positions for attaching said resilient member to said frame, each said attachment position corresponding to one said frame channel.

12. The bridge claimed in claim 11, wherein said opening has a plurality of sides and each said frame channel is the juncture between two said sides.

13. The bridge claimed in claim 12, wherein:

said resilient member is an O-ring;

each said attachment position comprises a pair of retainers; and said O-ring is retained by one said pair of retainers.

14. The bridge claimed in claim 13, wherein each said retainer comprises a retainer protuberance disposed outside said opening at the juncture between two said sides.

15. The bridge claimed in claim 14, wherein said frame has four sides.

16. The bridge claimed in claim 1, wherein said slide channel comprises two pairs of channel protuberances at opposite ends of said slide.

17. The bridge claimed in claim 1, wherein said slide channel comprises a plurality of ball bearings.

18. The bridge claimed in claim 17, wherein:

said slide channel comprises two pairs of channel protuberances at opposite ends of said slide; and each channel protuberance has one said ball bearing therein.

19. A bridge for playing billiards, comprising:

a body having a handle and a generally planar frame, said frame having a square opening defined by four sides, said frame having a plurality of retainers, each said retainer disposed outside said opening at the juncture between a pair of adjacent ones of said sides;

an elongated slide disposed in said opening having a slide channel for cradling said cue; and an O-ring spanning said frame between two said retainers and contacting said slide for biasing a cue cradled in said slide channel toward the juncture between a pair of adjacent ones of said sides.

* * * * *